United States Patent [19]

Ishii et al.

[11] 4,260,989

[45] Apr. 7, 1981

[54] ANTENNA SYSTEM FOR WINDOW GLASS OF AUTOMOBILE

[75] Inventors: Kenichi Ishii; Takayasu Hokusho, both of Yokohama, Japan

[73] Assignee: Asahi Glass Compamy, Limited, Tokyo, Japan

[21] Appl. No.: 28,651

[22] Filed: Apr. 10, 1979

[30] Foreign Application Priority Data

Apr. 11, 1978 [JP] Japan ..... 53-41784

[51] Int. Cl.[3] ..... H01Q 1/02; H01Q 1/32

[52] U.S. Cl. ..... 343/704; 343/713; 219/203

[58] Field of Search ..... 343/704, 711, 712, 713

[56] References Cited

U.S. PATENT DOCUMENTS

| | | | |
|---|---|---|---|
| 3,971,029 | 7/1976 | Torii et al. | 343/704 |
| 4,063,247 | 12/1977 | Sakurai et al. | 343/704 |
| 4,086,594 | 4/1978 | Kropielnickl et al. | 343/704 |
| 4,095,228 | 6/1978 | Mfinke et al. | 343/704 |
| 4,155,090 | 5/1979 | Kuroyanagi et al. | 343/704 |

*Primary Examiner*—Eli Lieberman

*Attorney, Agent, or Firm*—Oblon, Fisher, Spivak, McClelland & Maier

[57] ABSTRACT

An antenna system for a rear window glass of an automobile comprises a defogging electric heating element and patterned conductive strips for antenna wherein the configuration of the antenna and the configuration of the bus bars for the electric heating element are modified to improve non-directivity for FM radio broadcast wave for a radio receiver in the automobile.

13 Claims, 29 Drawing Figures

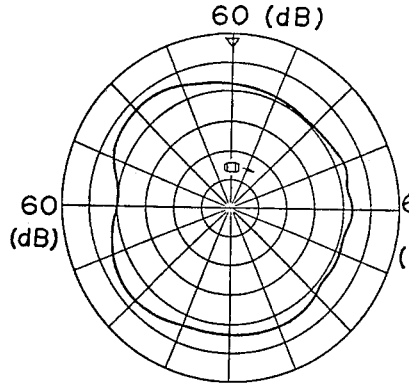
FIG. 16a
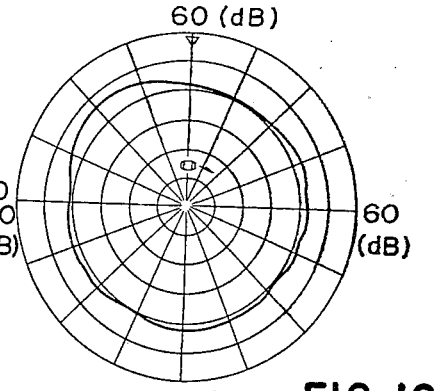
FIG. 16b
76 MHZ
80 MHZ
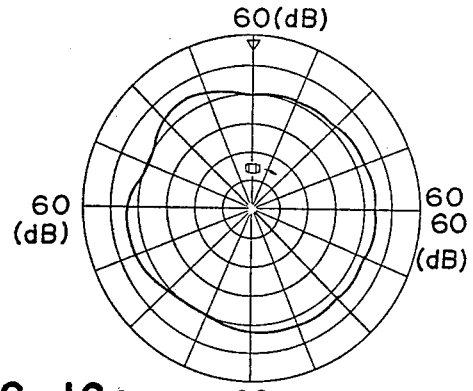
FIG. 16c
85 MHZ
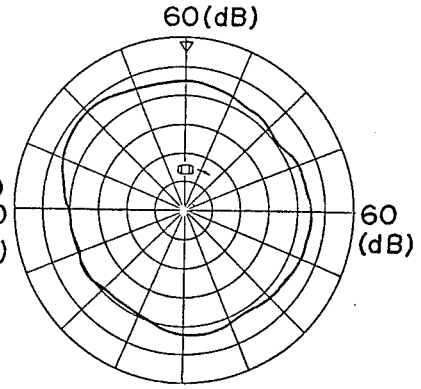
FIG. 16d
90 MHZ
FIG. 17
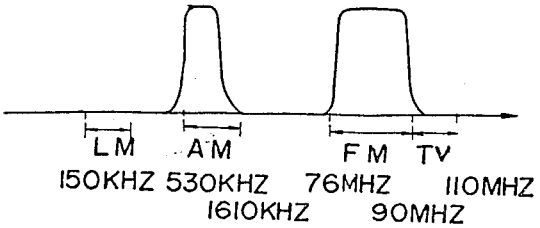

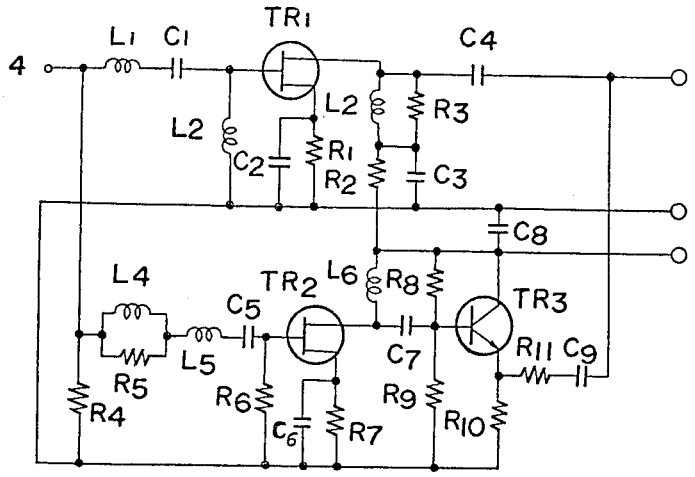
FIG. 18
FIG. 19a
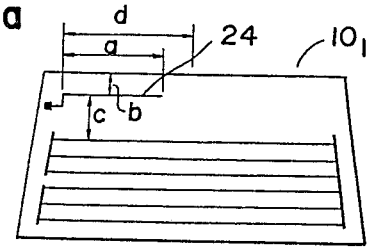
FIG. 19b
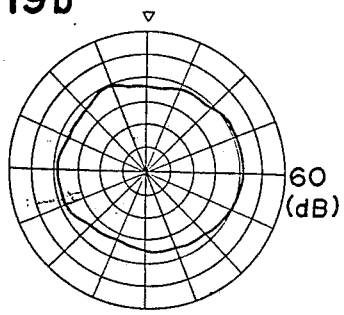
FIG. 19c
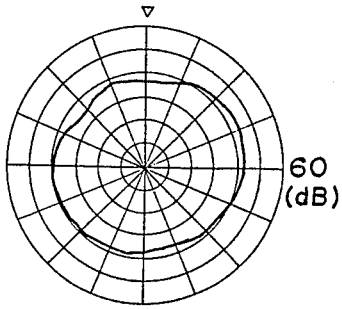

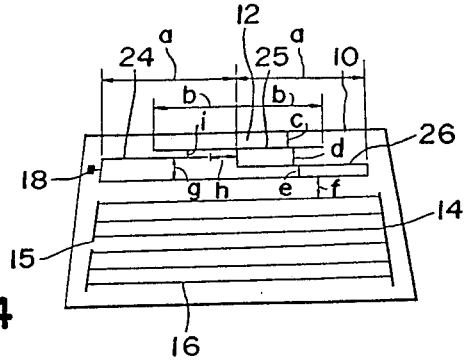
FIG. 24
FIG. 25a
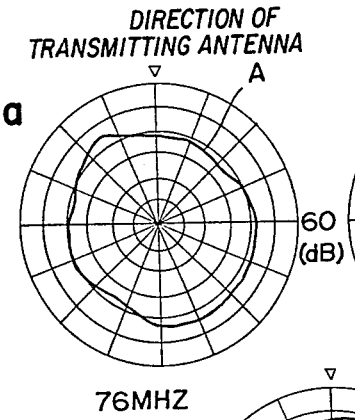
FIG. 25b
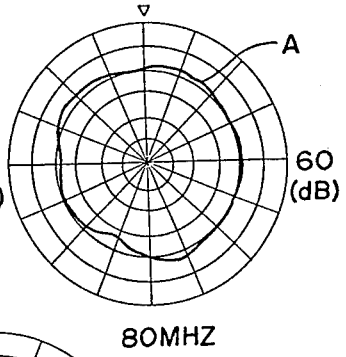
FIG. 25c
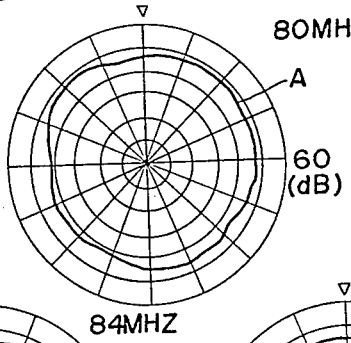
FIG. 25d
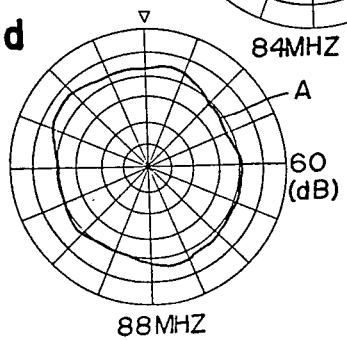
FIG. 25e
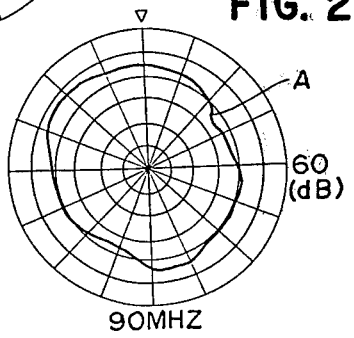

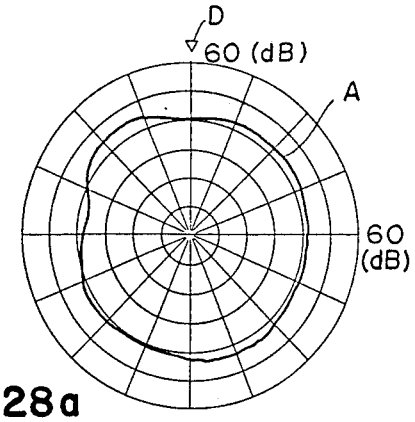
FIG. 28a
76MHZ
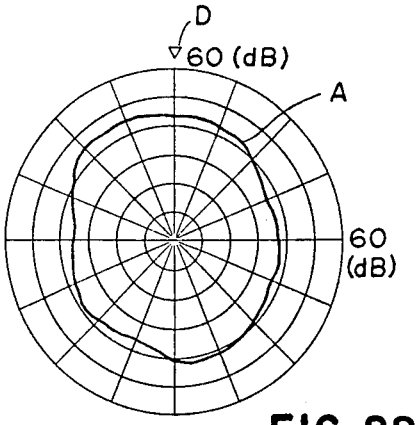
80MHZ
FIG. 28b
FIG. 28c
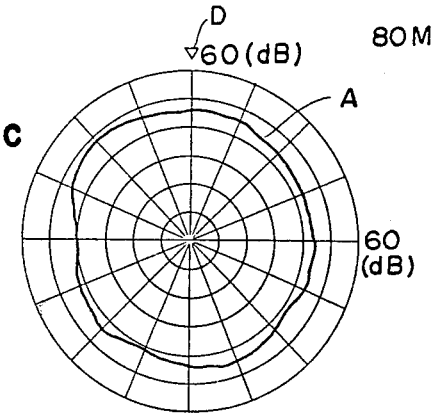
84MHZ
FIG. 28d
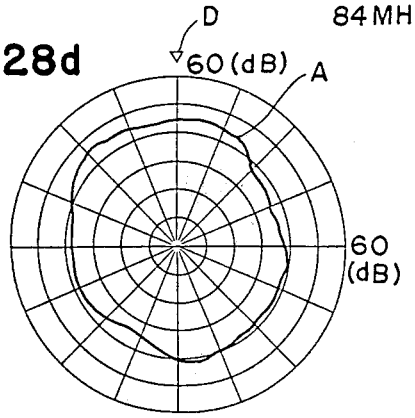
88MHZ
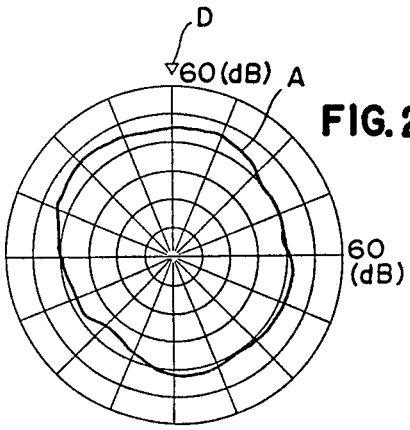
90MHZ
FIG. 28e

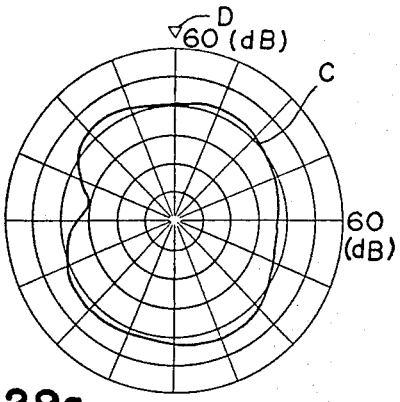
FIG. 29a
76MHZ
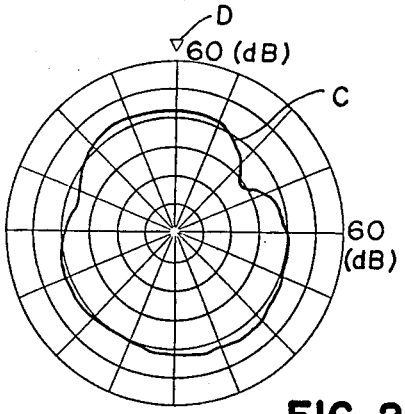
80MHZ
FIG. 29b
FIG. 29c
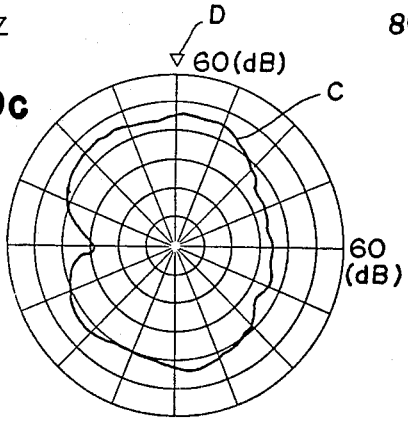
84 MHZ
FIG. 29d
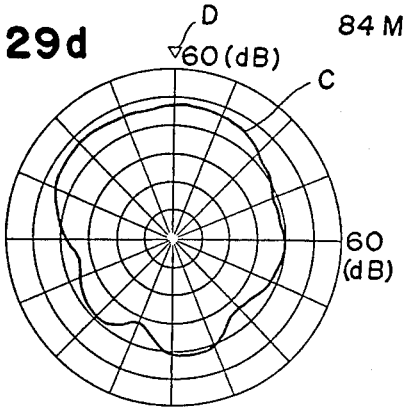
88 MHZ
FIG. 29e
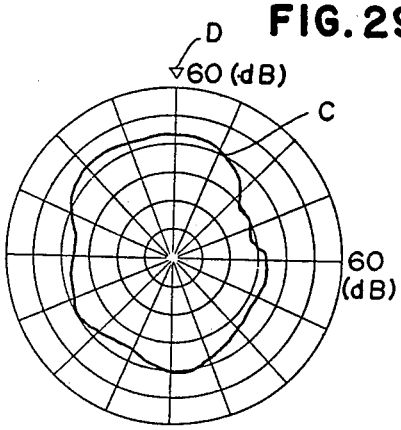
90MHZ

ANTENNA SYSTEM FOR WINDOW GLASS OF AUTOMOBILE

BACKGROUND OF THE INVENTION

1. Field of the Invention

The present invention relates to an improvement of an antenna system for a rear window glass of an automobile comprising a defogging electric heating element and an antenna.

2. Description of the Prior Art

A whip antenna has been widely used as an antenna for a radio receiver in an automobile. Recently, instead of the whip antenna, a glass antenna system such as AM broadcast antenna strip and FM broadcast antenna strip formed on or in a window glass of an automobile has been practically used.

The glass antenna system has not troubles of the whip antenna such as breaking of antenna by contacting with an obstacle or by bending in parking and deterioration of characteristic caused by dirt staining. However, when the antenna strip is formed on certain window glass, for example, at the upper edge of the window glass or at an upper space above a defogging electric heating element on the window glass, the space for the antenna strip is narrow to reduce the gain of the antenna disadvantageously.

The glass antenna system of an automobile has high directivity characteristics for receiving broadcast waves especially FM broadcast wave in comparison with the whip antenna whereby FM broadcast wave is not satisfactorily received by the glass antenna system in certain directions of travel of the automobile.

For example, when symmetrical antenna strips (3) are disposed at the upper space of the defogging window glass (1) having a plurality of printed heating strips (2) (electric resistance strips) and a feeding point (4) connecting to the lead wire junction (5) are disposed at the center of the rear window glass of the automobile as shown in FIG. 1, the characteristics such as the directivity characteristic curve A shown in FIG. 2 is given to FM broadcast wave such as 80 MHz. As it is clear from FIG. 2, the directivity characteristic curve of the glass antenna system shows a FIG. 8 characteristic having dip point in the case of coinciding with the X direction of the front-to-rear transmitting antenna and the direction of the automobile Y. The gain at the dip point is remarkably low such as 9.7 dB in comparison with the gain at the maximum point such as 45.4 dB. The FIG. 8 characteristic is usually found in the conventional glass antennas and is not only for the above-mentioned design of the glass antenna system. When the glass antenna system is used as a front window glass or a rear window glass, the FIG. 8 characteristic is significantly affected.

The inventors have studied on the directivity characteristic of the glass antenna system to FM broadcast wave. As the result, the inventors have found that the FIG. 8 characteristic of the glass antenna system formed on a front or rear window glass of an automobile to FM broadcast wave is highly affected by the configuration or design of the antenna, and the shape and a size of a body of an automobile since the secondary radiation of FM broadcast wave is caused by the body of the automobile.

When a high frequency amplifying circuit for amplifying high frequency current induced in the glass antenna system is used so as to increase sensitivity of the glass antenna system, the effect of needless waves causes noise. For example, strong TV waves are given in the frequency region just above FM radio broadcast wave band region whereby the strong TV waves adversely affect AM and FM broadcast receiving to cause the noise.

SUMMARY OF THE INVENTION

It is an object of the present invention to improve the directivity characteristic of the glass antenna system comprising a defogging electric heating element and an antenna to FM broadcast wave so as to give non-directive characteristics.

It is another object of the present invention to provide an antenna system for a rear window glass having a defogging electric heating element which cuts disturbance waves for causing noise in a radio receiver to improve noise characteristics.

The foregoing and other objects of the present invention have been attained by providing an antenna system which comprises a transparent glass plate, a defogging electric heating element made of a plurality of heating strips and a pair of bus bars at both sides of the heating strips disposed in a heated region on or in the glass plate; and an antenna disposed above the defogging electric heating element, which is improved to give non-directivity characteristic by reducing the FIG. 8 characteristic by dividing the bus bar on one side into two or more so as to form the ⊐-shaped feeding circuit of the electric heating element and by forming the antenna in asymmetrical pattern to the vertical center line of the rear window glass and by disposing a feeding point to the antenna at a side part.

The antenna system of the present invention comprises a high frequency amplifying circuit which amplifies at least one frequency band region of FM radio broadcast wave, AM radio broadcast wave, long wave radio broadcast or short wave radio broadcast wave, but cuts needless frequency bands such as frequency bands for TV broadcast higher than the frequency band for FM radio broadcast, and needless frequency band between FM radio broadcast wave and AM radio broadcast wave.

BRIEF DESCRIPTION OF THE DRAWINGS

FIGS. 3 to 14 and 24 are respectively front views of embodiments of antenna system of a rear window glass of an automobile according to the present invention;

FIGS. 16*a–d* are directivity characteristic distribution diagrams of the antenna system of FIG. 15;

FIG. 17 is a frequency characteristic diagram of one embodiment of a high frequency amplifying circuit used in the present invention;

FIG. 18 is a circuit diagram of the high frequency amplifying circuit;

FIGS. 19*a–c*, 20*a–c*; 21*a–c*, 22*a–c* 23*a–c*, and 24 are front views of antenna systems and directivity characteristic distribution diagrams of embodiments of the present invention;

FIGS. 25*a–e*, 28*a–e*, and 29*a–e* are directivity characteristic distribution diagrams of the practical antenna system of the present invention;

Figure 1:
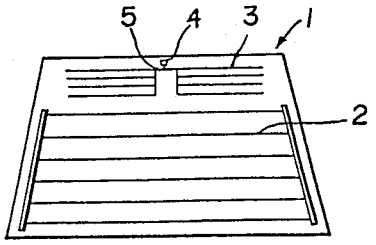
FIG. 1 PRIOR ART
FIG. 1 is a front view of one embodiment of the conventional antenna system for a rear window glass of an automobile.
Figure 2:
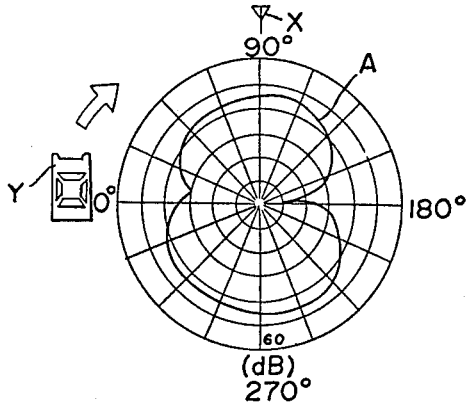
FIG. 2 PRIOR ART
FIG. 2 is a directivity characteristic distribution diagram of the conventional antenna system of FIG. 1.
Figure 3:
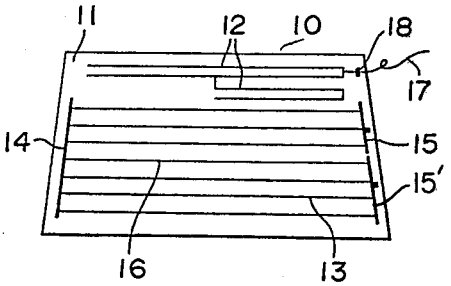
Figure 4:
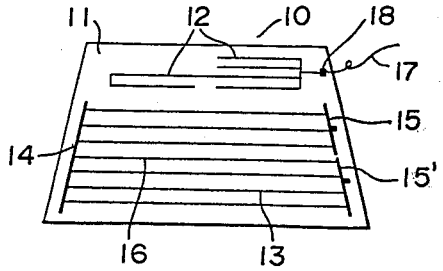
Figure 5:
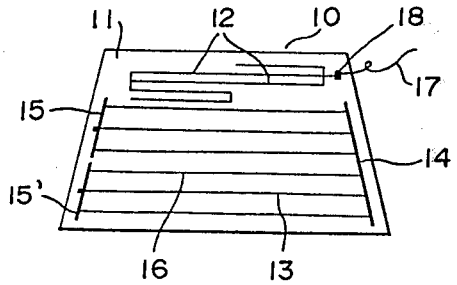
Figure 6:
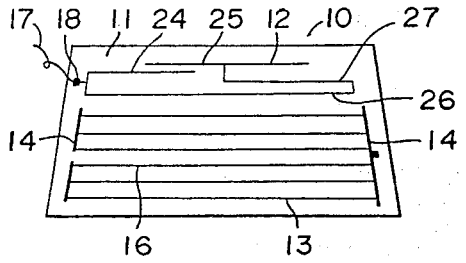
Figure 7:
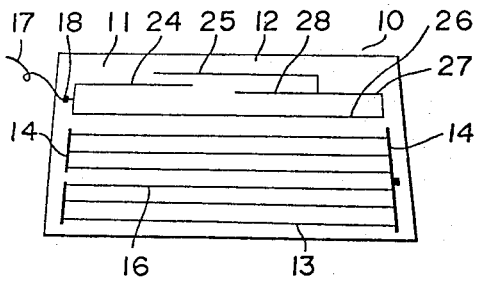

DETAILED DESCRIPTION OF THE PREFERRED EMBODIMENTS:

Referring to the drawings, the present invention will be illustrated.

The rear window glass having antenna system (10) of the present invention comprises an antenna (12) having specific patterned or configures strips, a defogging electric heating element (16) being made of a plurality of heating strips (13) and bus bars (14), (15), (15') and a feeding point (18) for connecting an antenna feeder line (17) and the antenna (12) as shown in FIGS. 3 to 10.

Figure 11:
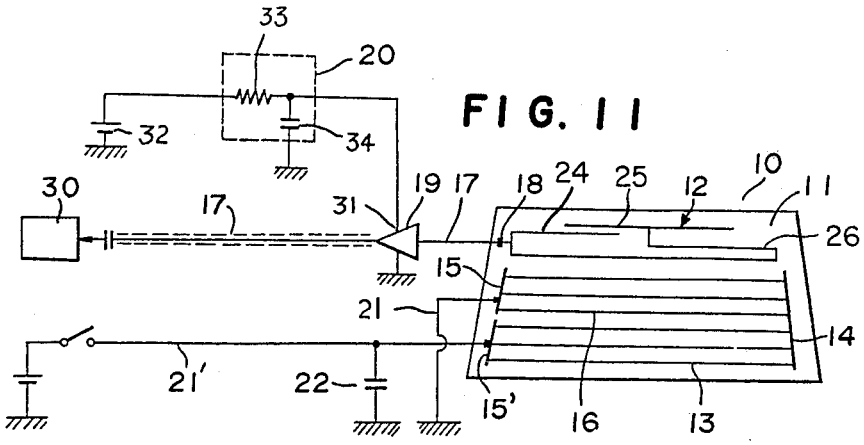
Figure 12:
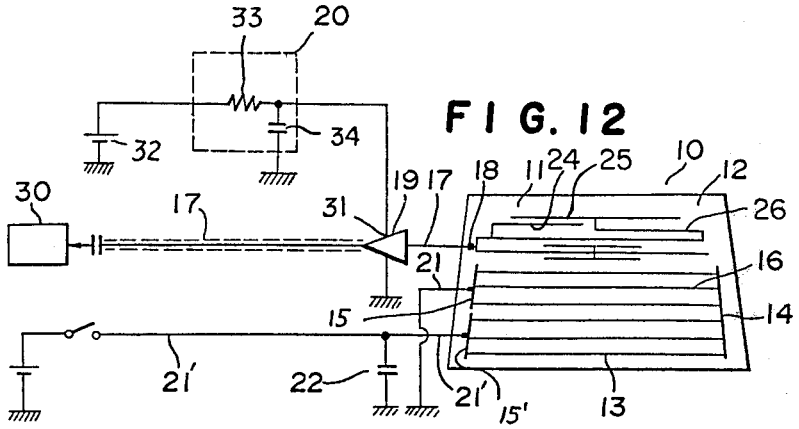
Figure 13:
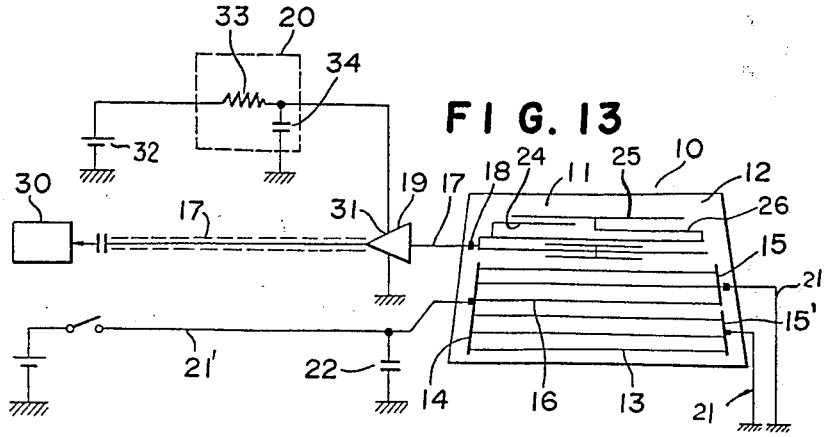

The antenna system (10) is connected to a high frequency amplifying circuit (19) for amplifying high frequency current induced in the antenna (12). A noise filter (20) is connected to a power terminal of the high frequency amplifying circuit (19) as shown in FIGS. 11 to 13.

The rear window having the antenna system of the present invention comprises defogging electric heating element (16) for preventing fogging of the rear window is disposed in the glass plate of the rear window at a desired heating region as shown in FIGS. 3 to 14. The defogging electric heating element (16) comprises a plurality of the heating strips (13) and the bus bars (14), (15), (15') connected at both sides of the heating strips (13).

In the typical example of the defogging electric heating element shown in FIGS. 3 to 13, a plurality of the heating strips (13) having a width of 0.5 to 2 mm are arranged in parallel with each gap of 2 to 4 cm in transversal direction of the glass plate fitted on a frame of the rear window and the bus bars (14), (15), (15') are arranged at both sides of the heating strips (13). These heating strips and bus bars are formed by printing an electric conductive paste prepared by dispersing silver powder and low melting glass frit in an organic medium, on or in the glass plate and baking the paste. It is possible to use an electric heating element comprising metal wires which are disposed between laminated glass sheets and bus bars connecting to both sides of the metal wire instead of the printed strips.

In order to reduce the directivity characteristic of the antenna for FM broadcast waves of caused by the defogging electric heating element (16), the bus bar at one side is divided into two or more parts 15, 15' whereby the pattern of the electric heating element (16) is in ⊐-shape. This is one feature of the antenna system of the present invention. The bus bar at one side is separated to form the upper bus bar (15) and the lower bus bar (15') in suitable length. Each lead wire (21),(21') is connected to the upper bus bar (15) and the lower bus bar (15') so as to pass the current from the lower bus bar (15') through the bus bar (14) at the opposite side to the upper bus bar (15) in ⊐-shape as shown in FIGS. 11 and 12. It is also possible to connect them so as to pass the current from the bus bar (14) to the bus bar (15) and the bus bar (15') as shown in FIG. 13.

In order to improve the directive characteristic for FM broadcast wave, the upper bus bar (15) is grounded. This is one feature of the present invention. In order to prevent noise caused by the power line for the defogging electric heating element and noise caused by the defogging electric heating element, a capacitor is connected between the power line and the earth.

In the embodiment shown in FIGS. 11 and 12, the upper bus bar (15) is grounded and the lower bus bar (15') is connected to the power line. The power line (21) of the heating element is grounded through the capacitor (22). In the embodiment shown in FIG. 13, both of the upper bus bar (15) and the lower bus bar (15') are grounded and the capacitor (22) is connected between the power line (21) of the bus bar (14) and the earth. The antenna (12) having specifically configured strips is disposed above the electric heating element (16) on the glass plate (11). The antenna (12) is separated from the electric heating element (16) for more than 2 cm to prevent electric shortcircuit and it is also separated from the frame of the window for about 1 to 6 cm to prevent lowering of antenna gain.

Figure 14:
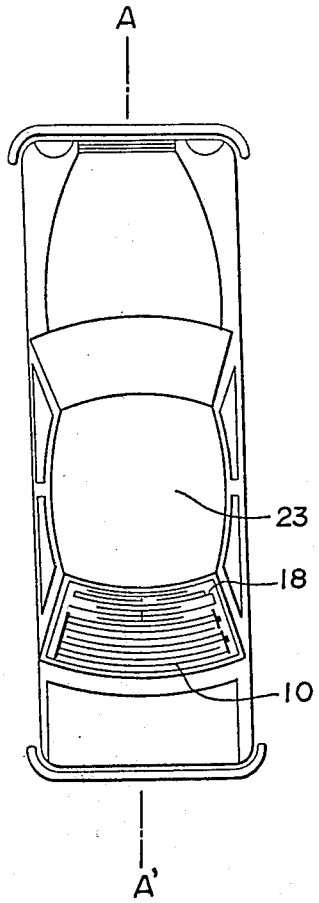

A suitable pattern or design of the antenna is selected so as to impart optimum characteristics depending upon a shape of an automobile, a shape, a size and a structure of the glass plate. The antenna design of the glass plate antenna fitted on the rear window frame having the defogging electric heating element is asymmetrical about a vertical center line A—A' of the automobile (23) as shown in FIG. 14. The feeding point for the antenna strips connecting the antenna feeder line is preferably disposed at the right or left side part of the window glass so as to improve the FIG. 8 characteristic.

Figure 8:
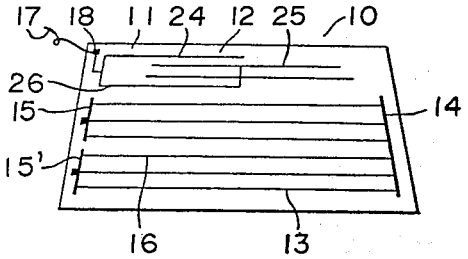
Figure 9:
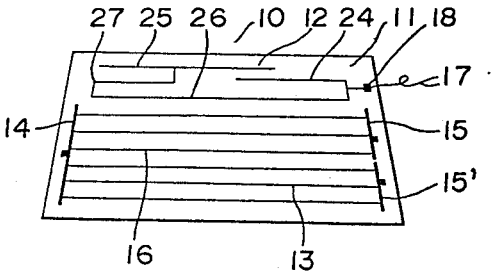

When the antenna pattern is asymmetrical relative to the vertical center line of the automobile and the feeding point for the antenna strips is disposed at right or left side part of the window glass, the center line for the function of the antenna is shifted from the center line of the automobile, for example, the direction of the function of the antenna can be shifted for about 90 degrees relative to the body of the automobile whereby the FIG. 8 directivity characteristic can be effectively improved.

The antenna strips are formed by printing the electric conductive paste in a desired pattern and baking it. The antenna strips can be also formed by disposing metal wires in the intermediate film for laminating glass sheets in a laminated glass plate. The antenna strips can be also formed by various manner on or in the window glass.

The antenna (12) can be designed in a pattern for imparting high gains for both of FM and AM broadcast waves to have the function for both of FM and AM broadcast bands. It is also possible to be designed in a pattern having a part for mainly receiving AM broadcast wave and a part for mainly receiving FM broadcast wave. It is also possible to be designed in a pattern having a part for receiving both of FM and AM broadcast waves and a part for mainly receiving AM broadcast wave.

The typical patterns of the antenna for the antenna system of the present invention are shown in FIGS. 6 to 13 wherein main antenna strip (24) having the feeding point (18) at the side of the glass plate (11) is disposed at one side above the heating element (16) on the glass plate (11) fitted to the rear window frame. An auxiliary antenna strip (25) is disposed with a specific gap from the main antenna strip (24) and it is extended in the transversal direction on the glass plate (11) near the window frame above or below the main antenna strip (24). The main antenna strip (24) is connected to the auxiliary antenna strip (25) through a phase adjusting antenna strip (26). This pattern is excellent. The main antenna strip (24) in the antenna system, is extended in the transversal direction from the side to the center on the glass plate (11) which is fitted to the rear window frame of the automobile.

The main antenna strip (24) is preferably connected the feeding point (18) through the lead wire at one end and it has free end at the opposite end to the feeding point (18). The main antenna strip (24) is preferably asymmetric to the vertical center line in the antenna system (10). The free end of the main antenna strip (24) is preferably disposed in center region of the antenna system (10). The main antenna strip (24) is not limited to a straight stip and can be plural strips, a branched strip, a returned strip or a curved strip. The length of the main antenna strip is preferably in a range of $\lambda/4\alpha \pm \lambda/20,\alpha$ wherein $\lambda$ designates wavelength of desired middle frequency for FM broadcast frequency region and $\alpha$ designates wavelength shortening coefficient of the antenna system. For example, it is preferably about 40 cm to 90 cm.

In the present invention, the auxiliary antenna strip (25) is disposed above the main antenna strip (24) or near the window frame at upper side part or below the main antenna strip (24) or near the window frame at lower side part. The auxiliary antenna strip (25) is extended to the transversal direction with a specific gap to the main antenna strip (24). The gap is preferably in a space width of 1 to 3 cm from the viewpoint of sensitivity for receiving.

When the auxiliary antenna strip (25) is disposed on the glass plate (11) near the window frame, a gap from the window frame is preferably about 1 to 5 cm. The auxiliary antenna strip has at least one free end. The auxiliary antenna strip (25) can be disposed on the glass plate (11) at the central part or at the side part. The length, width and numbers of the auxiliary antenna strip (25) can be decided depending upon a structure of the body of the automobile and a size of the window glass and the other factors. The optimum pattern of the auxiliary antenna is symmetrical pattern in the transversal direction. The phase adjusting antenna strip (26) is auxiliary actuated to adjust the phase to FM broadcast wave at the feeding point (18) of the main antenna strip (24) and the auxiliary antenna strip (25) which have different directivity characteristics and to composite the main antenna strip (24) and the auxiliary antenna strip (25) in the optimum condition and to increase the sensitivity of the receiving of AM broadcast wave. The length of the phase adjusting antenna strip (26) is selected to adjust the phase of the receiving wave region. The phase adjusting antenna strip (26) connects the feeding point of the main antenna strip (24) to the auxiliary antenna strip (25). For example, the length of the phase adjusting antenna strip (26) is given so as to resonate to the FM broadcast frequency band (76–90 $MH_z$). In particular, the length is given to be $\lambda/4$, $\frac{3}{4}/\lambda$, $5/4\lambda$, . . . $n/4\lambda$ wherein $\lambda$ designates wavelength of central frequency of FM broadcast frequency band and n is an odd number. It is preferable in practice, to be $\lambda/4 \pm \lambda/20$, $\frac{3}{4}\lambda \pm \lambda/20$, . . . $n/4\lambda \pm \lambda/20$.

In the antenna system on the window glass, the wavelength of the received broadcast wave is shortened whereby a wavelength shortening coefficient $\alpha$ is multipled to the wavelength. The phase adjusting antenna strip (26) including the auxiliary antenna strip (25) at one side on the antenna system (10) shown in FIG. 6 has a length of $\frac{3}{4}\lambda \times \alpha$ wherein $\lambda$ is about 83 $MH_z$ at the center of the FM broadcast frequency band; and $\alpha$ designates about 0.7 as the wavelength shortening coefficient. That is, the length of the phase adjusting antenna strip is about 1900 mm.

In the antenna system of the rear window glass of the conventional automobile, the length of $\frac{3}{4}\lambda$ is practically selected from the viewpoint of the size of the window glass and a limitation of the space for the antenna strips. It is practically selected to be $\frac{3}{4}\lambda \pm 1/20\lambda$ such as 1900 mm $\pm$100 mm as described above. The phase adjusting antenna strip (26) has preferably asymmetrical pattern to the vertical center line of the window glass and it is extended to the transversal direction to have each gap especially in substantially parallel to the main antenna strip (24) and the auxiliary antenna strip (25).

As shown in FIGS. 6 to 10, the pattern of the phase adjusting antenna strip (26) can have a returned part (27) or a branched part (28) or it can be formed by plural strips. The phase adjusting antenna strip (26) is connected to the main antenna strip (24) so as to prevent loss of the receiving sensitivity of the main antenna strip (24) and loss of the directivity characteristics of FM broadcast wave. For example, the phase adjusting antenna strip (26) is connected to the part of the main antenna strip (24) which is not main functional part of the main antenna strip (24) such as near the feeding point (18). The phase adjusting antenna strip (26) is also connected to the auxiliary antenna strip (25), so as to prevent loss of the receiving sensitivity of the main antenna strip (24) and loss of the directivity characteristics of FM broadcast wave. For example, the phase adjusting antenna strip (26) is connected at the center of the auxiliary antenna strip (25) or near the end of the auxiliary antenna strip (25).

The feeding point (18) to connect to the main antenna strip (24) is preferably disposed in a side region of the glass plate (11) at either right or left side, or either upper, middle or lower level. The position of the feeding point (18) is selected depending upon the design. The functional center line of the antenna system can be shifted from the vertical center line of the window glass whereby effect of secondary radiation of FM broadcast wave caused by the body of the automobile can be minimized and the FIG. 8 characteristic can be improved.

Figure 10:
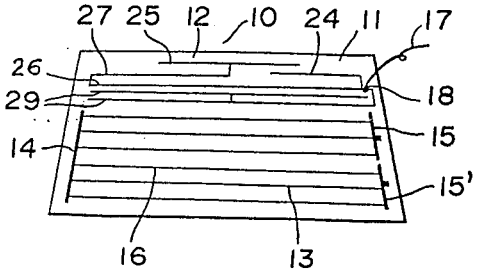

When AM broadcast receiving function is not enough by only these antenna strips, an antenna strip (29) for AM broadcast as shown in FIG. 10 can be connected. It is possible to connect a reactance element between the AM antenna strip (29) and the main antenna strip (24), the auxiliary antenna (25) or the phase adjusting antenna (26), whereby the received wave in FM broadcast wave band can cut so as to prevent loss of the directivity characteristics of FM broadcast wave by the AM antenna strip (29).

In the antenna system of the present invention, it is optimum to dispose the high frequency amplifying circuit (19) for AM, FM or a AM-FM broadcast wave.

FIGS. 11 to 13 show certain embodiments wherein the high frequency amplifying circuit (19) is connected between the feeding point (18) and a radio receiver (30).

It is preferably to use the high frequency amplifying circuit (19) having frequency characteristics for amplifying at least one of frequency band region for FM radio broadcast, AM radio broadcast, long wave radio broadcast or short wave radio broadcast whereas cutting disturbance waves which causes noise in receiving the radio broadcast wave such as TV broadcast wave, needless low frequency wave, needless high frequency wave and needless intermediate frequency wave.

The high frequency amplifying circuit can be formed by combining the high frequency amplifying circuits for amplifying the frequencies in said frequency band regions. Thus, it is advantageous to use an IC or discrete high frequency amplifying circuit for amplifying the frequencies in the desired frequency band regions from the viewpoint of cost and compact size. The radio receiver used in the automobile is usually designed to receive both of AM and FM radio broadcast waves. The high frequency amplifying circuit is preferably to amplify both of frequency band regions for FM radio broadcast and AM radio broadcast.

For example, AM radio broadcast wave is in a range of 535 to 1605 $KH_z$; FM radio broadcast wave is in a range of 76 to 90 $MH_z$ and TV broadcast wave is 90 to 770 $MH_z$ in Japan. Therefore, it is preferable to use the high frequency amplifying circuit designed to amplify the band regions of 535 to 1605 $KH_z$ and 76 to 90 $MH_z$ but to cut the band regions more than 90 $MH_z$. The band regions for middle wave broadcast, FM radio broadcast and TV broadcast wave are different in each country. The amplifying frequency band and the cut frequency band are selected to design the high frequency amplifying circuit so as to correspond to them.

The high frequency amplifying circuit can be connected in the radio receiver or between the feeding point of the antennas and the antenna terminal of the radio receiver, or it can be assembled on or in the glass plate in one piece or in bonding. It is preferable to connect a noise filter (20) for preventing noises of the power source (32) between the power input terminal (31) of the high frequency amplifying circuit (19) and the power source (32). In the noise filter (20) shown in FIGS. 10 to 12, a resistor (33) is connected in series between the power input terminal (31) and the power source (32), and a capacitor (34) is connected to the power input terminal and is grounded at the opposite end so as to prevent the noises. The noise filter is not critical and can be selected from various type noise filters. The noise filter (20) can be connected in the high frequency amplifying circuit or it can be connected between the power feeder wires or it can be connected to the power source.

FIG. 17 is a frequency characteristic diagram of one embodiment of a high frequency amplifying circuit (19).

FIG. 18 is a circuit diagram of one embodiment of the high frequency amplifying circuit.

In the embodiment, the signal is input from the antenna system and is divided into FM radio band and AM radio band. The $TR_1$ is used for FM radio band and the $TR_2$ and $TR_3$ are used for AM radio band and they are respectively amplified and composited.

Only FM radio band (76 to 90 $MH_z$) is amplified by the impedance matching and the filter effect with the antenna pattern and L and C to cut the other bands. On the other hand, only AM radio band (535 to 1605 $KH_z$) is passed and amplified by the filter having L, C and R.

In order to compare the characteristics of the antenna system of the present invention with those of the other antenna systems, the following antenna systems are prepared and the directivity characteristics are measured. The glass antenna system $(10)^1$ comprising the main antenna strip (24) having the pattern of FIG. 19(*a*), wherein a=415 mm; b=35 mm; c=65 mm and d=515 mm. The glass antenna system $(10)_2$ comprising the main antenna strip (24) and the phase adjusting antenna strip (26) having the pattern of FIG. 20(*a*), wherein a=415 mm; b=35 mm; c=35 mm; d=515 mm; e=30 mm.

Figure 20A:
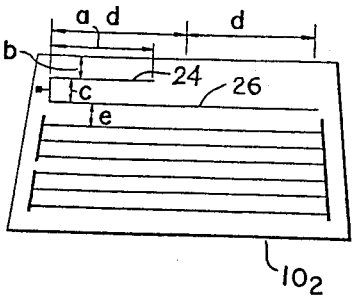
Figure 20B:
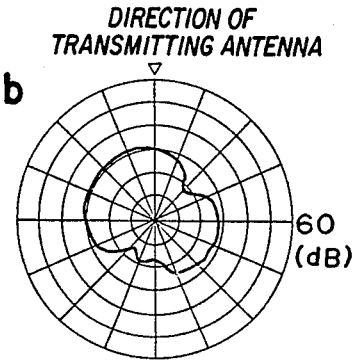
Figure 20C:
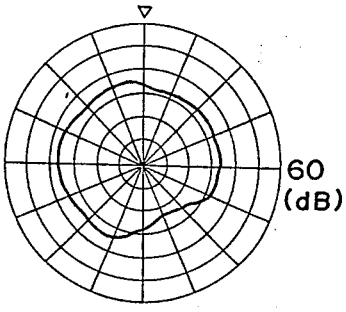
Figure 21A:
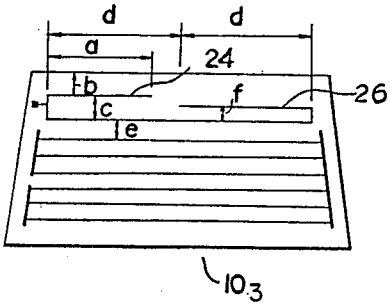
Figure 21B:
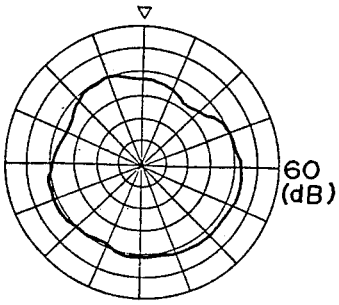
Figure 21C:
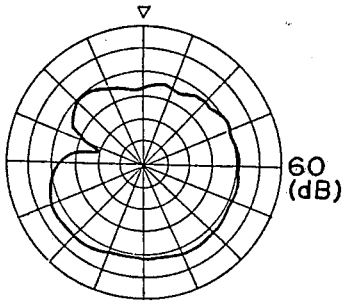
Figure 22A:
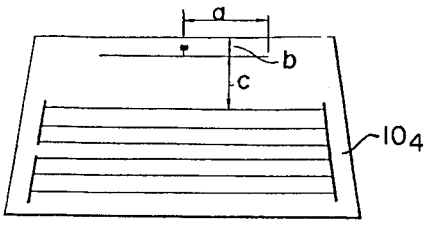
Figure 22B:
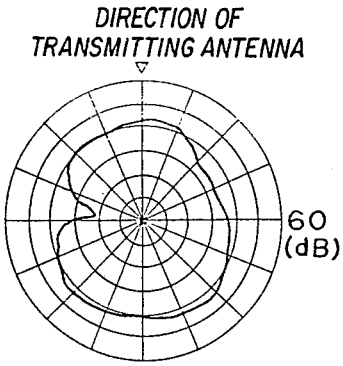
Figure 22C:
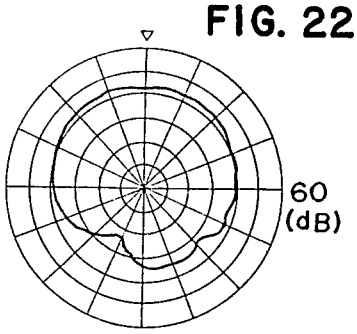

The glass antenna system $(10)_3$ comprising the phase adjusting antenna strip (26) (it is extended from that of FIG. 20) having the pattern of FIG. 21(*a*) wherein a=415 mm; b=35 mm; c=35 mm; d=515 mm; e=30 mm and f=20 mm. The glass antenna system $(10)_4$ comprising the auxiliary antenna strip (25) having the pattern of FIG. 22(*a*) wherein a=300 mm; b=25 mm; c=75 mm and. The glass antenna system $(10)_5$ comprising in combination, the main antenna strip (24), the phase adjusting antenna strip (26) and the auxiliary antenna strip (25) having the pattern of FIG. 23(*a*) wherein a=515 mm; b=300 mm; c=25 mm; d=25 mm; e=20 mm; f=30 mm; g=35 mm; h=100 mm; and i=10 mm.

The results of the directivity characteristic measurements are shown in FIGS. 19*b* and *c* to 23*b* and *c*. The FIGS. 19(*b*)-23(*b*) show the results of the directivity characteristics at 80 $MH_z$. The FIG. 19(*c*)-23(*c*) show the results of the directivity characteristics at 84 $MH_z$.

As is clear from the figures, the antenna system having the main antenna strip, the auxiliary antenna strip and the phase adjusting antenna strip has higher gain for receiving than that of the antenna system having the main antenna strip and or an auxiliary antenna strip or the main antenna strip and the phase adjusting antenna strip (6 dB higher than that of only the main antenna strip and 6 dB higher than that of only the auxiliary antenna strip at 84 $MH_z$). The improvement of the FM directivity characteristic is also improved.

Figure 23A:
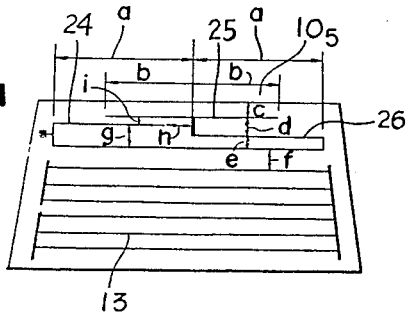
Figure 23B:
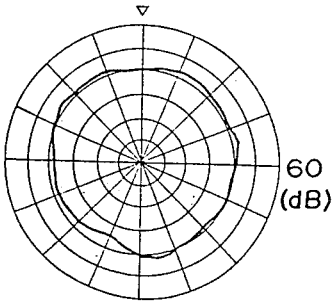
Figure 23C:
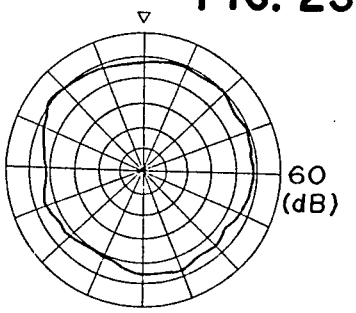

FIG. 20(*a*) shows the antenna system having the phase adjusting antenna strip whose length is not enough to adust the phase. As it is clear from FIGS. 20(*b*) and 20(*c*), the directivity characteristic and the receiving sensitivity are remarkably inferior to those of the antenna system having enough length of the phase adjusting antenna strip (FIGS. 21 and 23).

The present invention will be further illustrated by certain examples and references which are provided for purposes of illustration only and are not intended to be limiting the present invention.

EXAMPLE 1

Antenna strips and electric heating elements having the patterns of FIG. 24 were formed by printing a silver paste by a silk screen printing process on a glass plate and baking the paste to form a glass antenna system wherein the parts had the following lengths and distances: a=515 mm; b=300 mm; c=25 mm; d=25 mm; e=20 mm; f=30 mm; g=35 mm; h=100 mm; i=10 mm.

The directivity characteristic distribution curve obtained by measuring the directivity characteristics in various FM broadcast frequencies are shown in FIGS. 25*a-e* as the curve A. The results of the directivity characteristics at the frequencies are shown as follows.

| Figure 25 (a) | (b) | (c) | (d) | (e) |
|---|---|---|---|---|
| ($MH_z$) 76 | 80 | 84 | 88 | 90 |

As it is clear from the figures, the FIG. 8 directivity characteristic was remarkably improved in the FM frequency band region.

EXAMPLE 2

Figure 26:
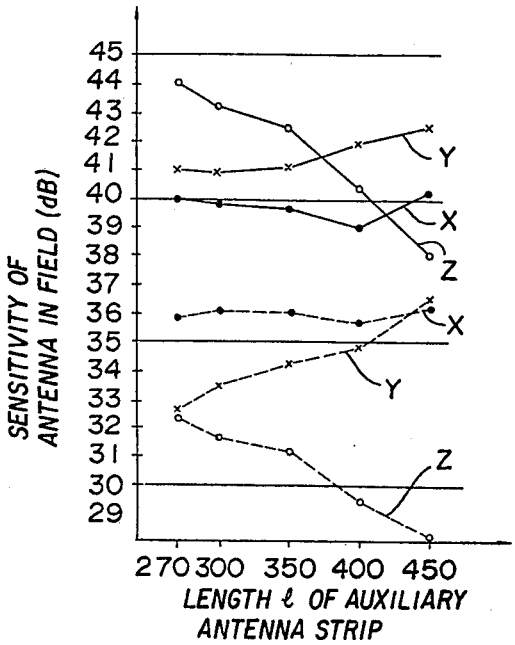
FIG. 26 is a graph of sensitivity (dB) of the antenna to length (mm) of an auxiliary antenna strip.
Figure 27:
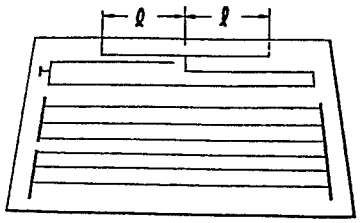
FIG. 27 shows the length l of the auxiliary antenna strip.

In the pattern of FIG. 24 (the lengths and distances other than a are the same), the length a of the auxiliary antenna strip (l in FIG. 27) was varied to 270 mm, 300 mm, 350 mm, 400 mm, or 450 mm and the average values and the minimum values of the receiving sensitivities at 76 $MH_z$, 84 $MH_z$ or 90 $MH_z$ were measured. The results are shown in FIG. 26 as the graph of the receiving sensitivity to lengths of the auxiliary antenna strip. As it is clear from the graph, when the length l of the auxiliary antenna strip is about 300 mm such as 250 mm to 350 mm, the sensitivities for whole frequency band regions are suitable.

In FIG. 26, the full line shows the average value of the receiving sensitivities of the antenna in the 60 dB field and the dotted line shows the minimum value of the receiving sensitivities. Moreover, the receiving sensitivities in various frequencies are shown by x at 76 $MH_z$ (. symbol) y at 84 $MH_z$ (x symbol) and z at 90 $MH_z$ ( ⊙ symbol).

EXAMPLE 3

Antenna strips and electric heating element having the patterns of FIG. 11 were formed by printing a silver paste by a silk screen printing process on a glass plate and baking the paste and the resulting glass plate having the antenna system was fitted as a rear window glass of an automobile as shown in FIG. 11. The directivity characteristics at various FM radio broadcast frequencies were measured. The resulting directivity characteristics distribution curve is shown as the curve A in FIGS. 28*a–e*.

The directivity characteristics were measured without a high frequency amplifying circuit in a uniform field intensity of 60 dB for various FM broadcast frequency band regions of 76 $MH_z$, 80 $MH_z$, 84 $MH_z$, 88 $MH_z$, or 90 $MH_z$.

EXAMPLE 4

Antenna strips and electric heating element having the patterns of FIG. 12 were formed by printing a silver paste by a silk screen printing process on a glass plate and baking the paste and the resulting glass plate having the antenna system was fitted as a rear window glass of an automobile as shown in FIG. 12. The directivity characteristics at various FM radio broadcast frequencies were measured. The resulting directivity characteristic distribution curves are shown as the curve A of FIGS. 16*a–d*.

The directivity characteristics were measured without a high frequency amplifying circuit in a uniform field intensity of 60 dB for various FM broadcast frequency band regions of 76 $MH_z$, 80 $MH_z$, 85 $MH_z$, or 90 $MH_z$.

REFERENCE

Figure 15:
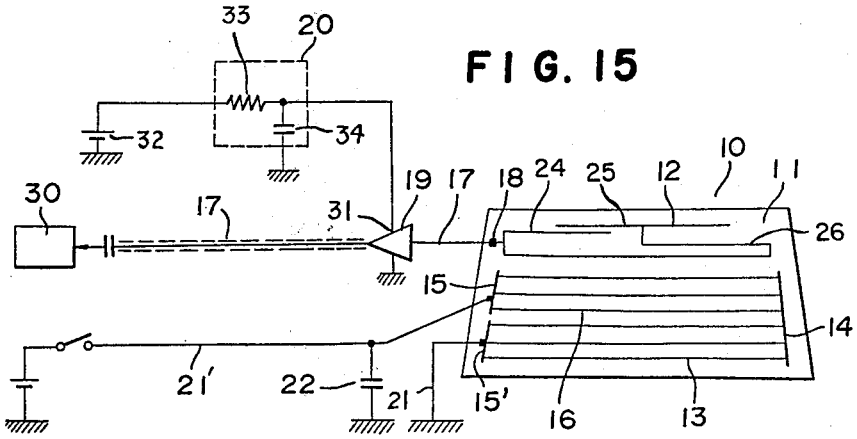
FIG. 15 shows an antenna system as the reference.

One of the bus bars of the defogging electric heating element was divided into two parts in the pattern and the lower bus bar was grounded to form the antenna system of FIG. 15 for an automobile. The directivity characteristics to FM broadcast wave were measured. The directivity characteristic distribution curves are shown as the curve C of FIGS. 29*a–e*.

As it is clear from the results of Examples 3 and 4 and Reference 1, the antenna system of the present invention had uniform gain and superior non-directivity characteristic to FM radio broadcast wave in comparison with those of Reference 1.

What is claimed as new and desired to be secured by Letters Patent of the United States is:

1. In an antenna system for a window glass of an automobile, comprising: a transparent glass plate; a defogging electric heating element made of a plurality of heating strips and a pair of bus bars at both sides of the heating strips disposed in a heating region of the glass plate; and an antenna disposed above the defogging electric heating element; the improvement characterized in that the winding pattern of the antenna is asymmetric to the vertical center line of the window glass; a feeding point to the antenna is disposed at a side part of the window glass; and the antenna comprises a main antenna strip and an auxiliary antenna strip disposed adjacent and parallel to the main antenna strip with a gap in the top to bottom direction of the window glass, and a phase adjusting antenna strip connecting the main antenna strip to the auxiliary antenna strip.

2. An antenna system according to claim 1 wherein one end of the main antenna strip is a free end.

3. An antenna system according to claim 1 wherein the main antenna strip and the auxiliary antenna strip are disposed in the transverse direction of the window glass in substantially parallel, spaced apart relationship.

4. An antenna system according to claim 1 wherein the main antenna strip, the auxiliary antenna strip and the phase adjusting antenna strip are disposed in the transverse-direction at different steps.

5. An antenna system according to claim 1 wherein a length of the phase adjusting antenna strip including the auxiliary antenna strip part is $n\lambda\alpha/4 \pm \lambda\alpha/20$ wherein n is the wavelength of the mean frequency of the FM broadcast frequency band; and $\alpha$/is the wavelength shortening coefficient of the antenna.

6. An antenna system according to claim 1 wherein the antenna made of the main antenna strip, the auxiliary antenna strip and the phase adjusting antenna strip is asymmetrical relative to the vertical center line of the window glass.

7. In an antenna system for a window glass of an automobile, comprising: a transparent glass plate; a defogging electric heating element made of a plurality of heating strips and a pair of bus bars at both sides of the heating strips disposed in a heating region of the glass plate; and an antenna disposed above the defogging electric heating element, the improvement characterized in that one of the pair of bus bars at one side is divided into an upper bus bar and a lower bus bar; the antenna is asymmetric to the vertical center line of the window glass; and a feeding point of the antenna is disposed at a side part of the window glass, whereby the FM directional characteristic of the antenna is improved.

8. An antenna system according to claim 7 wherein the upper bus bar of the defogging electric heating element is grounded.

9. An antenna system according to claim 7 wherein the upper bus bar of the defogging electric heating element is grounded and the lower bus bar is connected to a power source and a line of the power source is grounded through a capacitor.

10. An antenna system according to claim 7 which further comprises a high frequency amplifying circuit connected with the antenna for amplifying high frequency current induced in the antenna by at least one of FM radio broadcast waves, AM radio broadcast waves, long wave radio broadcast waves and short wave radio broadcast waves.

11. An antenna system according to claim 7 wherein a noise filter circuit is connected between a power input terminal of a high frequency amplifying circuit and a power source for the amplifying circuit.

12. An antenna system according to claim 7 wherein the other of the pair of bus bars of the defogging electric heating element is connected to a power source and the line of the power source is grounded through a capacitor, the upper bus bar and lower bus bar both being grounded.

13. An antenna system according to claim 12, wherein an additional antenna strip for AM reception is connected to the feeding point for the antenna.

* * * * *